US010513851B2

(12) United States Patent
Gelbaum

(10) Patent No.: US 10,513,851 B2
(45) Date of Patent: Dec. 24, 2019

(54) CURVED REFLECTIVE SKYLIGHT CURB INSERT TO DIFFUSE INCIDENT SUNLIGHT IN THE AZIMUTHAL DIRECTION

(71) Applicant: David Gelbaum, Cosa Mesa, CA (US)

(72) Inventor: David Gelbaum, Cosa Mesa, CA (US)

( * ) Notice: Subject to any disclaimer, the term of this patent is extended or adjusted under 35 U.S.C. 154(b) by 0 days.

(21) Appl. No.: 15/884,084

(22) Filed: Jan. 30, 2018

(65) Prior Publication Data

US 2018/0216346 A1 Aug. 2, 2018

Related U.S. Application Data

(60) Provisional application No. 62/452,059, filed on Jan. 30, 2017.

(51) Int. Cl.
*E04D 13/03* (2006.01)
*E06B 9/24* (2006.01)

(52) U.S. Cl.
CPC ..... *E04D 13/033* (2013.01); *E06B 9/24* (2013.01); *E06B 2009/2417* (2013.01); *E06B 2009/2482* (2013.01)

(58) Field of Classification Search
CPC ..... E04D 13/033; E06B 9/24
See application file for complete search history.

(56) References Cited

U.S. PATENT DOCUMENTS 4,344,261 A * 8/1982 Weisner ..... B29C 51/082 52/200
4,505,069 A * 3/1985 Freeman ..... E06B 9/264 49/64
4,809,468 A * 3/1989 Bareiss ..... E04D 13/03 362/147
5,285,315 A * 2/1994 Stiles ..... E06B 9/24 359/592
D364,469 S * 11/1995 Eijadi ..... D25/48.7
5,467,564 A * 11/1995 DeKeyser ..... E04D 13/03 52/173.3
5,648,873 A 7/1997 Jaster et al.
5,670,774 A * 9/1997 Hill ..... G01S 3/784 126/573
5,675,487 A * 10/1997 Patterson ..... E06B 9/32 700/56
6,105,318 A * 8/2000 Harrison ..... E06B 9/24 52/200
RE38,217 E * 8/2003 DeBlock ..... E04D 13/03 359/591
7,995,277 B2 * 8/2011 Patterson ..... E06B 7/086 359/591
8,601,757 B2 * 12/2013 Jaster ..... E04C 2/54 359/592
8,723,092 B2 * 5/2014 Bartenbach ..... F21V 11/04 250/203.4
8,837,048 B2 * 9/2014 Jaster ..... G02B 17/00 359/592
9,027,292 B2 * 5/2015 O'Neill ..... E04D 13/03 52/173.3
9,074,408 B2 * 7/2015 Sung ..... E06B 7/02
9,796,153 B1 * 10/2017 Tsodokov ..... B32B 29/08
(Continued)

*Primary Examiner* — Paola Agudelo

(57) ABSTRACT

The present disclosed subject matter is a curved reflective skylight curb insert which intercepts and reflects low sun elevation angle sunlight, thereby minimizing glare and providing more uniform illumination within the building below.

2 Claims, 5 Drawing Sheets

(56) References Cited

U.S. PATENT DOCUMENTS

| | | | | |
|---|---|---|---|---|
| 2008/0104903 | A1* | 5/2008 | Jaster | E04D 13/033 52/200 |
| 2009/0205699 | A1* | 8/2009 | Chang | H01L 31/0543 136/246 |
| 2011/0103088 | A1* | 5/2011 | Wemmer | F21S 11/00 362/555 |
| 2015/0354223 | A1* | 12/2015 | Biron | E04D 13/033 362/276 |

* cited by examiner

CURVED REFLECTIVE SKYLIGHT CURB INSERT TO DIFFUSE INCIDENT SUNLIGHT IN THE AZIMUTHAL DIRECTION

CROSS REFERENCES

This application is a non-provisional of provisional application No. 62/452,059 entitled Curved Reflective Skylight filed Jan. 30, 2017. The entirety of which is herein incorporated by reference.

BACKGROUND

Solar collectors gather direct and limited ambient sunlight and direct it toward a target area. Active solar collector systems employ a mechanism for tracking the sun's trajectory across the sky to maximize the amount of sunlight collected. Active systems may be highly efficient solar collectors, however the required tracking mechanisms add complexity and expense to the system. By contrast, passive solar collector systems employ a fixed reflector system to direct light toward a target area. Passive systems are relatively less complex and less expensive, however passive systems are generally less efficient than active systems.

Daylighting systems are a particular type of solar collector which may be used to provide illumination for the interior of a building by directing daylight into the building. Daylight, as used in connection with the present invention, includes all forms of sunlight whether direct or ambient. Because of cost constraints, most daylighting systems are passive systems which employ fixed reflectors and/or refractors to direct daylight through an aperture into a building.

Conventional skylights mounted on conventional curbs suffer from glare when the sun is low in the sky, i.e., when the sun's elevation angle is small. For such prior-art skylights and curbs, sunlight can enter the building at an angle closer to horizontal than vertical, and such light can enter the eyes of people inside the building, causing discomfort. Previous attempts to solve this problem have sometimes used diffusing domes at the top of the skylight or diffusing windows at the bottom of the skylight, or both. These diffusing domes and windows are expensive and they also suffer major optical losses in transmitting the sunlight into the building. None of these previous attempts to solve the low sun elevation angle glare problem have provided high optical efficiency, low cost, and adequate glare prevention.

The present subject matter minimizes the low sun elevation angle glare problem while also providing high optical efficiency and low cost. The present subject matter uses a simple curved reflective insert in the curb supporting the skylight. The curved reflective insert spreads the incident low sun elevation angle light widely in the azimuthal direction, thereby minimizing glare. The only optical loss is related to the reflectance of the mirror material, which can be 95% or higher with available cost-effective reflective materials. Furthermore, for high sun elevation angle light, the reflective insert does not intercept much of this light and therefore causes extremely small optical losses.

The present subject matter can take many different forms, from a single curved reflector to multiple curved reflectors, and each reflector can have a variety of different curved shapes. The reflectors in the present disclosed subject matter are specularly reflective on both sides, and they are placed inside the curb of the skylight, making the reflectors simple, easy to make and install, and therefore very economical. The reflectors can be installed in the curb below any type of skylight, making them very adaptable to a variety of applications, from big-box stores to offices to residences.

The present subject matter represents a unique new skylight curb insert employing curved reflectors to minimize glare from low sun elevation angle skylights.

In one embodiment the disclosed subject matter is a unique skylight curb insert comprising one or more curved reflective surfaces to spread low sun elevation angle sunlight in the azimuthal direction to minimize glare from the skylight into the building below. This disclosed subject matter is simple, easy to manufacture, easy to install, and therefore extremely cost-effective. The disclosed subject matter provides outstanding optical throughput efficiency.

An embodiment includes a light passage for providing daytime lighting to a building, the light passage includes a curb defining the lateral boundaries of a light passage into an interior of the building; wherein the lateral boundaries extend from an interior opening in the building to an exterior opening outside the building. The light passage further includes a strip within the curb, the strip having a length and width which define at least one surface which is reflective, the width extending vertically from the interior opening towards the exterior opening of the curb; and wherein the strip is curved along the length such that the radius of curvature of the curve is perpendicular to vertical.

In another embodiment the light passage includes a strip within the curb, the strip having a length and width which define at least one surface which is reflective, the width extending vertically from the interior opening towards the exterior opening of the curb; and wherein the strip is bent such that the edge defining the bend is vertical.

In still another embodiment the disclosed subject matter is a diffusing dome with a pyramid reflector and diffuser that is economically superior to a clear dome with pyramid reflector.

In yet another embodiment, the disclose subject matter is a diffusing dome and a diffuser with no reflector which is economically superior to a clear dome with pyramid reflector.

DETAILED DESCRIPTION

Figure 1:
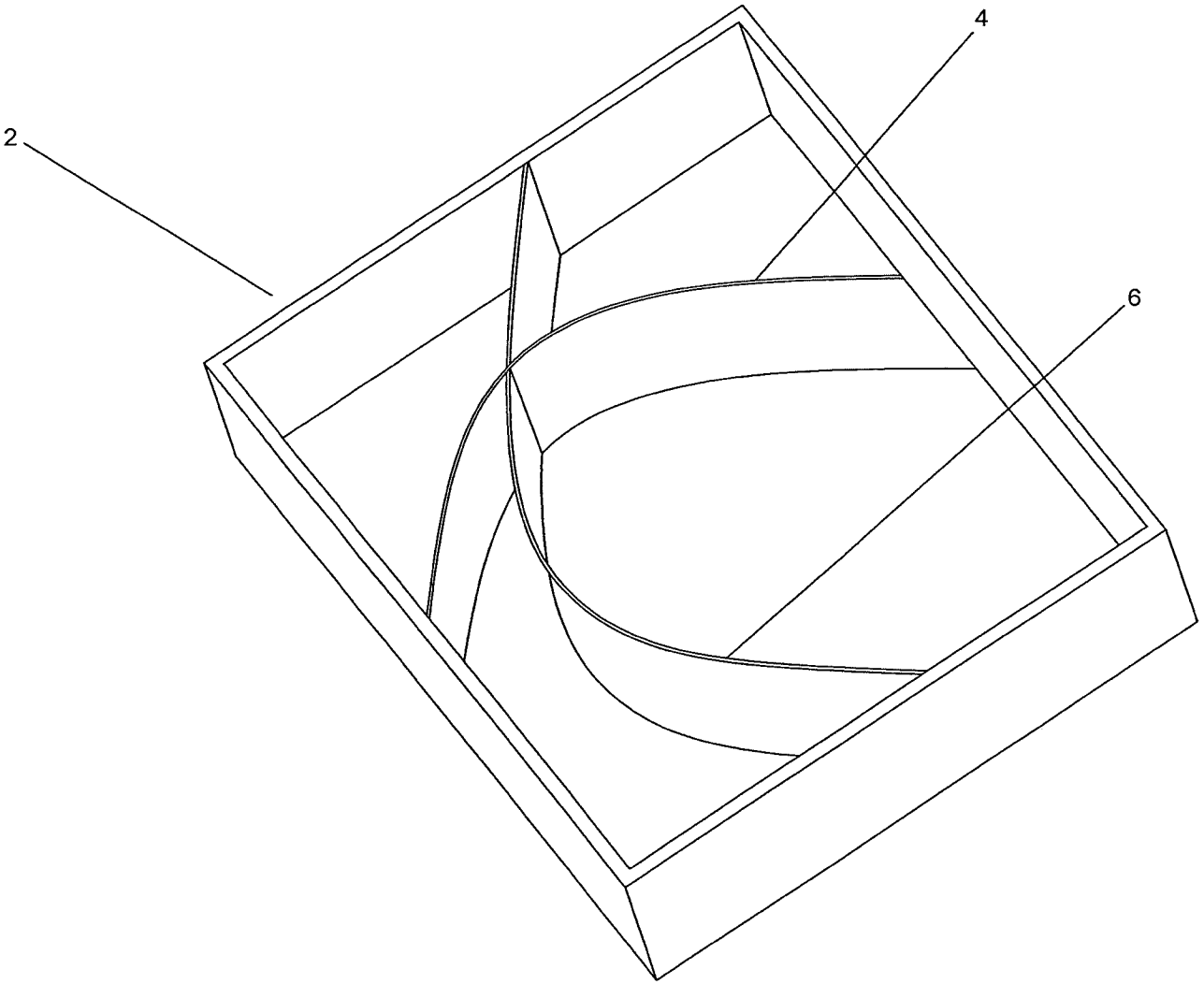
FIG. 1 presents a perspective view of one embodiment of the new reflective skylight curb insert, including two intersecting curved reflectors.
Figure 2:
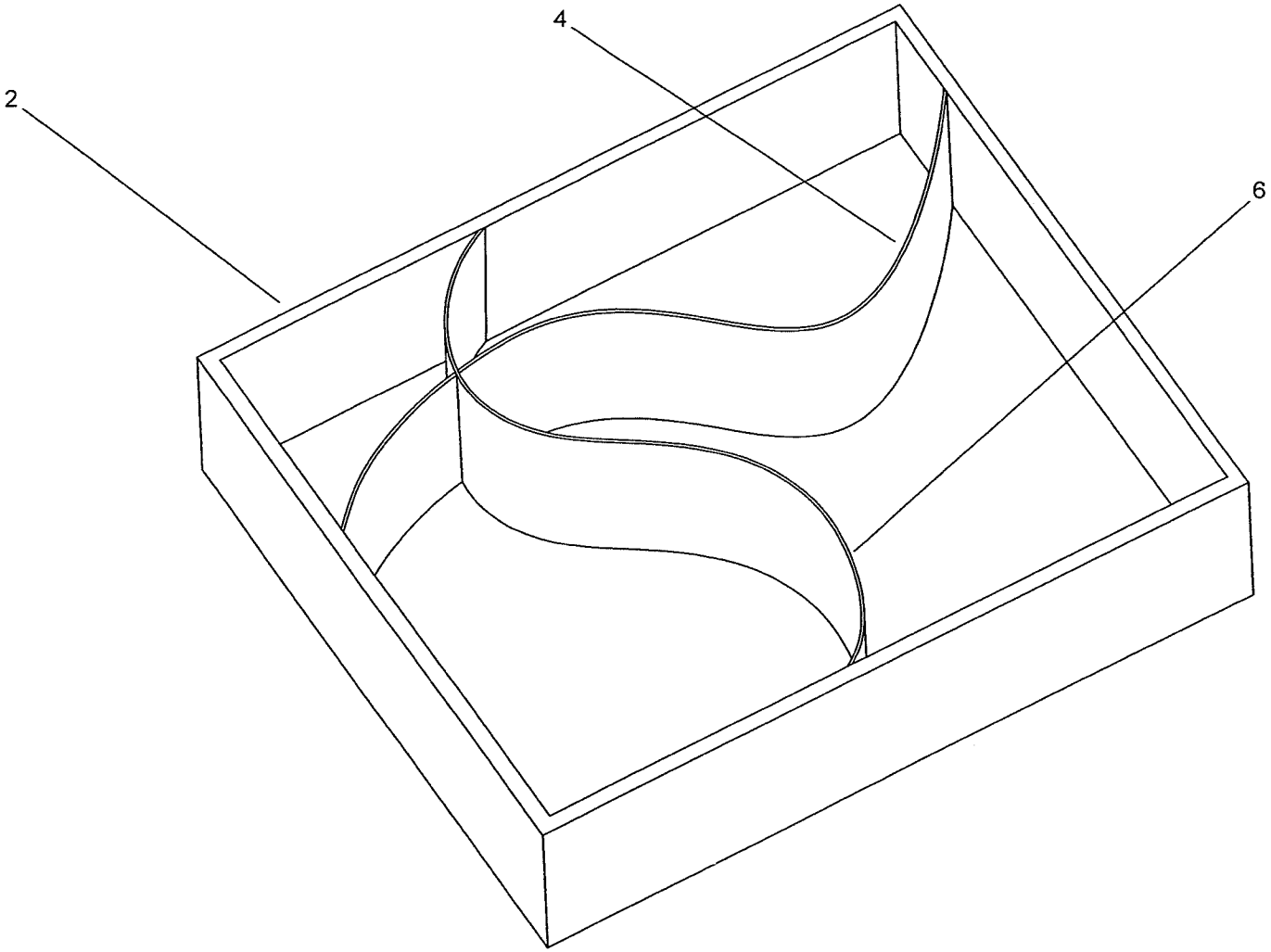
FIG. 2 presents a perspective view of a second embodiment of the new reflective skylight curb insert, including two intersecting curved reflectors of a different shape than those in FIG. 1.
Figure 3:
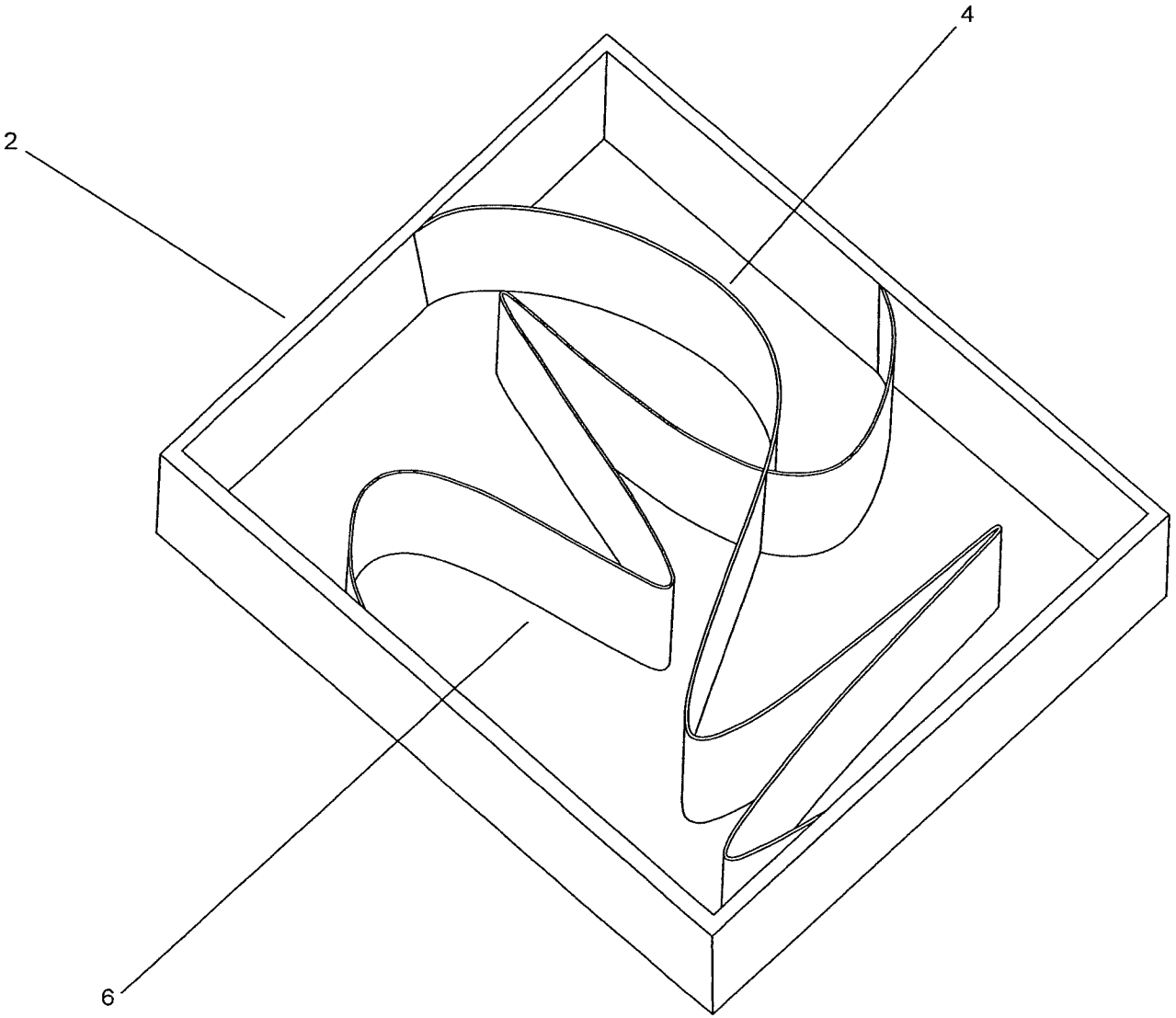
FIG. 3 presents a perspective view of a third embodiment of the new reflective skylight curb insert, including two intersecting curved reflectors of a different shape than those in FIG. 1 or 2.
Figure 4:
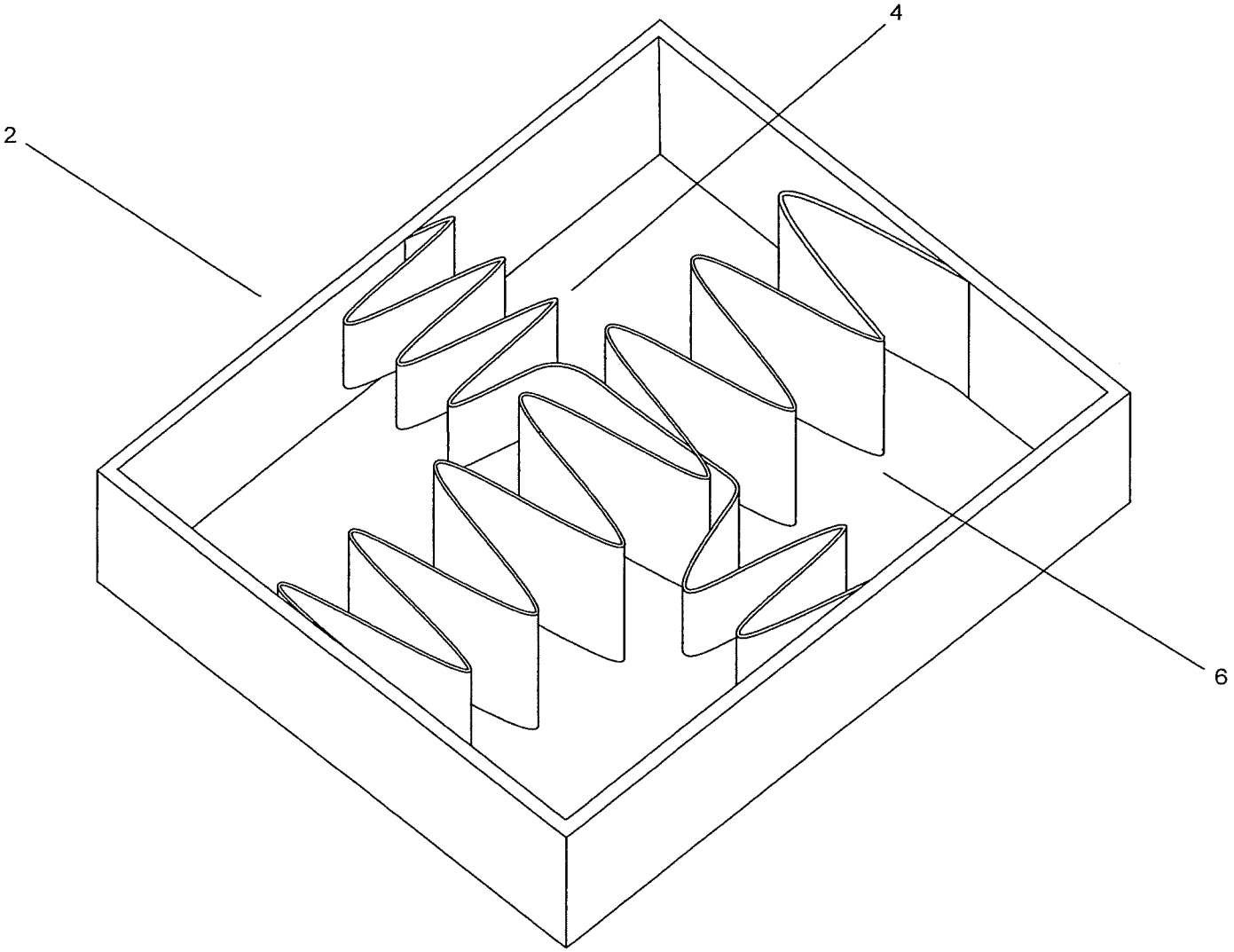
FIG. 4 presents a perspective view of a fourth embodiment of the new reflective skylight curb insert, including two intersecting curved reflectors of a different shape than those in FIGS. 1,2 or 3.

The present disclosed subject matter is best understood by referring to the four attached figures. None of these figures include details of the skylight dome or other transmissive elements within the skylight assembly, because these items are not critical to the present disclosed subject matter and are also well known to those of ordinary skill in the art of skylights. The only important elements of the present disclosed subject matter relate to the curb, which encloses the curved reflective insert comprising the main element of the present disclosed subject matter. Referring to the isometric views of FIGS. 1, 2, 3, and 4, the new curved reflective skylight insert comprises multiple intersecting curved reflectors exemplified by elements 4 and 6 inside a skylight curb 2. Low sun elevation angle sunlight will intercept one of more of these curved reflectors 4 and 6 and be spread by reflection into a broad range of reflected ray angles due to the curvature of the reflectors 4 and 6. The spreading of the sunlight in the azimuthal direction will reduce glare and make the light pattern within the building more uniform and pleasant to the occupants. In contrast, high sun elevation angle sunlight will pass through the curb with very little interaction with the curved reflective elements 4 and 6. Thus the new disclosed subject matter targets low sun elevation angle sunlight for spreading, while allowing high sun elevation angle sunlight to enter the building unobstructed. The reflectors 4 and 6 are made of a specularly reflective material on both sides. One such commercially available material is called Alanod, and includes a super-reflective coating on a thin aluminum sheet. Such a thin aluminum sheet can be easily formed into the curved shapes of the reflectors 4 and 6 in FIGS. 1, through 4.

The preferred embodiments of the new curved reflective skylight curb insert in FIGS. 1 through 4 are merely exemplary, and the configuration may be modified by those of ordinary skill of the art to perform the functions taught by this disclosed subject matter, while still falling within the scope and spirit of this disclosed subject matter. For example, a single curved reflective element 4 could be used instead of two reflective elements 4 and 6. For another example, three or four intersecting reflective elements could be used instead of two intersecting reflective elements 4 and 6. For yet another example, the curb 2 could be round or hexagonal or any other shape than the rectangular shape shown in FIGS. 1 through 4.

As shown in the figures, multiple curves may be formed in the reflective elements 4 and 6, as well as bends, corners, zigzags etc. While the purpose of the reflective elements (strips) is to reduce glare the elements, so long as form follow function may be arranged to represent letters, or other patterns.

An aspect of the discloses subject matter is that the reflective elements 4 and 6 may be contained within the bounds of the curb itself and thus independent of the skylight features above the curb and treatments below the curb.

The strips as described herein may be provided as an insert for current light passages. The strips may be provided to the end user pre-shaped and sized, leaving only the assembly and placement of the insert within the curb to the end users. The strips may be assembled with cooperating slots where the elements (strips) intersect or other connecting means. The inserts may also be fully assembled, or on the other extreme, may require sizing or shaping by the end user prior to installation.

While the reflective elements are shown as rectangular sheets, it is also envisioned that the strips may be of varying widths, such as a wave pattern, saw toothed or ramped, the restraint being they remain bounded by the curb structure.

While the curved reflective inserts described above reduce glare without unduly sacrificing performance, the reduction of glare along with economically providing lighting to interior area can also be accomplished with a diffusing dome. Jaster et al., U.S. Pat. No. 5,648,873, the entirety of which is incorporated herein by reference, discloses a clear dome, reflective pyramid and a diffuser within the curb to transmit and disperse light to a target area. However, it has been determined that the substitution of a diffusing dome in place of the Jaster's clear dome results in a more economical and efficient system.

The reasons for the superior performance are several, First the diffusing dome scatters some low sun elevation angle light down onto the diffuser and into the building aperture whereas the low sun elevation angle light would go all the way through the clear dome. Second, the light that's scattered down onto the diffuser by the diffusing dome has its incidence angle onto the diffuser decreased by the scattering and lowering the incidence angle onto the diffuser increases transmittance through the diffuser. Furthermore, the diffusing dome transmits less high sun elevation angle light than the clear dome does, which increases energy saving and reduces the air conditioning load.

Figure 5:
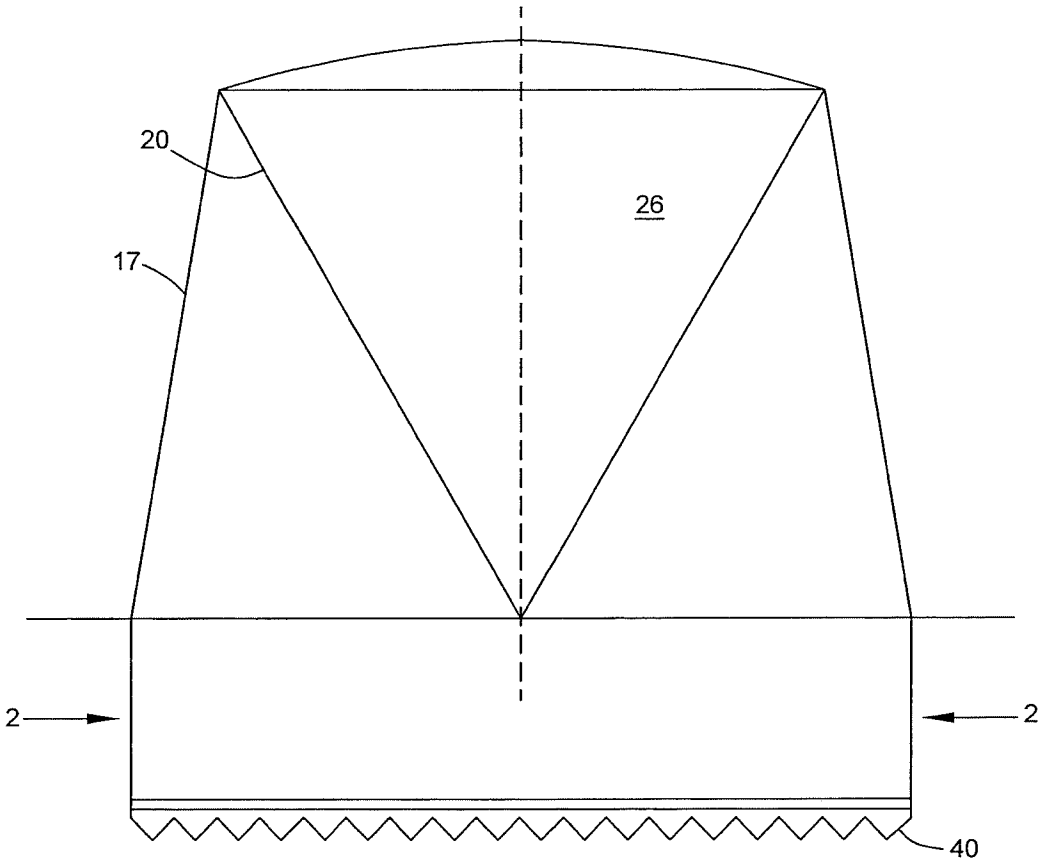
FIG. 5 presents a side view of an embodiment of a diffusing skylight having a diffusing dome, reflector and diffuser.

Referring to FIG. 5, according to one embodiment the diffusing dome 17 includes a reflective surface 26 of reflector 20. The reflective surface may be in the shape of an inverted cone, pyramid, wedge or other polygonal form.

The mechanism for suspending reflector 20 from support structure 16 is not critical to the present invention; reflector 20 may be suspended from support structure using any number of conventional suspension mechanisms or adhesive bonding techniques. Alternatively, reflector 20 may be formed as an integral part of housing 10.

A light diffusing lens structure 40 is suspended beneath curb 2 between reflector 20 and the target area in the building such that light reflected from reflector 20 passes through the light diffusing lens structure 40 and is distributed by the light diffusing lens structure 40. The exact location of light diffusing lens structure 40 is not critical to the present invention. The principal criteria is that light diffusing lens structure 40 must be displaced from reflector 20 and disposed in the optical path between reflector 20 and the target area in the building. It will be appreciated by one of ordinary skill in the art that the diffusing lens structure 40 need not be physically connected with curb 2. For example, in some applications, it may be advantageous to position diffusing lens structure 40 at a point displaced from curb 2.

The particular structure of the diffusive lens structure 40 is not critical to the present invention. Any suitable diffusive lens structure may be used in a daylighting system in accordance with the present invention. A wide variety of diffusive lighting panels are commercially available. Examples include Prismatic Light Controlling Lenses commercially available from ICI Acrylics, St. Louis, USA, and Daylighting Radial Lens commercially available from 3M Company, St. Paul, USA. Other suitable diffusers include diverging lenses, fresnel lenses, diverging radial lenses, and diverging linear lenses.

Having described aspects of the physical structure of one embodiment of a solar collector in accordance with principles of the present invention, various advantages and features of the present invention will be described below in connection with a discussion of the operating principles of the solar collector.

In use, a solar collector in accordance with principles of the present invention is preferably positioned adjacent an opening, or aperture, in the roof of a building. Referring again to FIG. 5, the solar collector is preferably positioned such that conical reflector 20 is centered about an axis that extends through the aperture. Daylight, both ambient and direct, incident on the reflective surface 26 of reflector 20 is redirected through the aperture and toward the target area in the building. The light reflected by conical reflector 20 passes through diffusive lens structure 40, which disperses the light throughout the target area, thereby providing more uniform illumination.

An important aspect of the embodiment described in FIG. 5 is that unlike the prior art, the dome 17 is not clear or transparent, but rather diffusing, such that the light has already been subject to diffusion prior to reflection by the reflector 20.

According to testing the inventors have discovered the diffusing dome configuration is more economical than the clear dome system described by Jaster. As a premise to the testing, it was determined it takes only 223 skylights with clear domes and pyramids to provide the same number of Daylight Hours as 233 diffusing domes with pyramids.

| Test | Daylight Hours | A/C tonnage Cost | Annual Energy Savings (Capitalized at 5%) | Demand Reduction (Capitalized at 5%) | Cost of skylights ($1600 per skylight) |
|---|---|---|---|---|---|
| 223 Clear domes with pyramid | 3177 | −$132,154 | $902,224 | $90,720 | −$355,200 |
| 233 Diffusing dome with pyramid | 3177 | −$106,199 | $920,654 | $100,800 | −$372,800 |
| Diffusing minus clear | | $25,955 | $18,430 | $10,080 | −$17,600 |
| Total $ Difference | | | $36,865 | | |

The testing shows that the economic value of 233 diffusing domes with pyramids is $36,865 more than the economic value of 223 clear domes with pyramids, even though both collections of skylights provide the same number of Daylight Hours and provide equally smooth distributions on the floor.

Next the diffusing domes with no reflector pyramids where compared to clear domes with pyramids. Again, 223 Clear domes with pyramids provided the same number of Daylight Hours as 233 diffusing domes with pyramids. The diffusing domes with no pyramids cost less per skylight than the clear domes with pyramids.

| Test | Daylight Hours | A/C tonnage Cost | Annual Energy Savings (Capitalized at 5%) | Demand Reduction (Capitalized at 5%) | Cost of skylights |
|---|---|---|---|---|---|
| 223 Clear domes with pyramid | 3177 | −$132,154 | $902,224 | $90,720 | −$355,200 ($1600 per skylight) |
| 233 Diffusing dome with pyramid | 3177 | −$135,267 | $906,346 | $95,760 | −$349,500 ($1600 per skylight) |
| Diffusing minus clear | | −$3,113 | $4,122 | $5,040 | $5,700 |
| Total $ Difference | | | $11,749 | | |

This test showed that the economic value of 233 diffusing domes with no pyramids is $11,749 greater than the economic value of 223 clear domes with pyramids, even though both collections of skylights provide the same number of daylight hours and provide equally smooth distributions on the floor.

While the foregoing written description of the disclosed subject matter enables one of ordinary skill to make and use what is considered presently to be the best mode thereof, those of ordinary skill will understand and appreciate the existence of variations, combinations, and equivalents of the specific embodiment, method, and examples herein. The disclosed subject matter should therefore not be limited by the above described embodiment, method, and examples, but by all embodiments and methods within the scope and spirit of the disclosed subject matter.

I claim:

1. A light passage for providing daytime lighting to a building comprising;

a curb defining the lateral boundaries of a light passage into an interior of the building; wherein the lateral boundaries extend from an interior opening in the building to an exterior opening outside the building;

a strip within the curb, the strip having a length and width which define at least one surface which is reflective, the width extending vertically from the interior opening towards the exterior opening of the curb; and wherein the strip is bent such that the edge defining the bend is vertical;

where the strip further comprises a curve along the length such that the radius of curvature of the curve is perpendicular to vertical.

2. The light passage of claim 1, further comprising a second strip, the second strip having a second length and second width which define at least one surface which is reflective, the second width extending vertically from the interior opening towards the exterior opening of the curb.

* * * * *